US009008973B2

(12) United States Patent
French

(10) Patent No.: US 9,008,973 B2
(45) Date of Patent: Apr. 14, 2015

(54) WEARABLE SENSOR SYSTEM WITH GESTURE RECOGNITION FOR MEASURING PHYSICAL PERFORMANCE

(76) Inventor: Barry French, Bay Village, OH (US)

( * ) Notice: Subject to any disclaimer, the term of this patent is extended or adjusted under 35 U.S.C. 154(b) by 1165 days.

(21) Appl. No.: 12/927,155

(22) Filed: Nov. 8, 2010

(65) Prior Publication Data

US 2011/0112771 A1 May 12, 2011

Related U.S. Application Data

(60) Provisional application No. 61/280,827, filed on Nov. 9, 2009.

(51) Int. Cl.

| | |
|---|---|
| ***G01P 15/00*** | (2006.01) |
| ***A63B 24/00*** | (2006.01) |
| *A63B 21/072* | (2006.01) |

(Continued)

(52) U.S. Cl.

CPC ..... *A63B 24/0062* (2013.01); *A63B 21/072* (2013.01); *A63B 24/0003* (2013.01); *A63B 24/0084* (2013.01); *A63B 24/0087* (2013.01); *A63B 69/0028* (2013.01); *A63B 71/0616* (2013.01); *A63B 2024/0009* (2013.01); *A63B 2024/0068* (2013.01); *A63B 2024/0071* (2013.01); *A63B 2071/0625* (2013.01); *A63B 2071/0666* (2013.01); *A63B 2071/0683* (2013.01); *A63B 2220/20* (2013.01); *A63B 2220/40* (2013.01); *A63B 2220/803* (2013.01); *A63B 2220/836* (2013.01); *A63B 2225/20* (2013.01); *A63B 2225/50* (2013.01); *A63B 2244/08* (2013.01); *A63B 2244/09* (2013.01)

(58) Field of Classification Search

CPC ..... A63B 24/0062; A63B 24/0084; A63B 24/0087

USPC ..... 702/19, 75, 141, 142; 482/8; 600/595

See application file for complete search history.

(56) References Cited

U.S. PATENT DOCUMENTS

| | | | |
|---|---|---|---|
| 4,761,005 | A | 8/1988 | French et al. |
| 4,824,107 | A | 4/1989 | French |
| 4,883,271 | A | 11/1989 | French |

(Continued)

OTHER PUBLICATIONS

Sato, Kimitake et al.,"Barbell Acceleration Analysis on Various Intensities of Weighlifting", 27 International Conference on Biomechanics in Sports, (Aug. 2009).

(Continued)

*Primary Examiner* — Mohamed Charioui

(74) *Attorney, Agent, or Firm* — Renner, Otto, Boisselle & Sklar, LLP

(57) ABSTRACT

A wearable sensor system with gesture recognition for measuring physical performance 98 includes a sensor ring 100 for providing signals corresponding to finger movement to an information processor 101. The sensor ring 100 internally includes an accelerometer 106 for measuring motion of a predetermined finger, the measured motion corresponding to an exercise routine performed by a user of the system 98, a processor 109 for conditioning the signals from the accelerometer 106, and a transceiver 108 for transmitting the conditioned signals to the information processor 101 for display and feedback to the user for accessing the quality of the exercise. The system 98 further includes means for allowing the user to start and stop the processing of the measured finger motion by moving the finger with sensor ring 100 thereon a predetermined distance and speed.

26 Claims, 4 Drawing Sheets

(51) Int. Cl.

| | |
|---|---|
| *A63B 69/00* | (2006.01) |
| *A63B 71/06* | (2006.01) |

(56) References Cited

U.S. PATENT DOCUMENTS

| | | | |
|---|---|---|---|
| 5,099,702 | A | 3/1992 | French |
| 5,469,740 | A | 11/1995 | French et al. |
| 5,524,637 | A | 6/1996 | Erickson |
| 6,073,489 | A | 6/2000 | French et al. |
| 6,098,458 | A | 8/2000 | French et al. |
| 6,308,565 | B1 | 10/2001 | French et al. |
| 6,430,997 | B1 | 8/2002 | French et al. |
| 6,749,432 | B2 | 6/2004 | French et al. |
| 6,765,726 | B2 | 7/2004 | French et al. |
| 6,876,496 | B2 | 4/2005 | French et al. |
| 7,038,855 | B2 | 5/2006 | French et al. |
| 7,359,121 | B2 | 4/2008 | French et al. |
| 7,791,808 | B2 | 9/2010 | French et al. |
| 7,864,168 | B2 | 1/2011 | French |
| 8,503,086 | B2 | 8/2013 | French et al. |
| 2001/0015123 | A1* | 8/2001 | Nishitani et al. ..... 84/615 |
| 2008/0090703 | A1* | 4/2008 | Rosenberg ..... 482/8 |
| 2008/0204225 | A1 | 8/2008 | Kitchen |
| 2009/0069722 | A1 | 3/2009 | Flaction et al. |
| 2014/0134584 | A1 | 5/2014 | French |
| 2014/0142439 | A1 | 5/2014 | French |

OTHER PUBLICATIONS

Chang, Keng-hao et al., "Tracking Free-Weight Exercises", UbiComp 2007: Ubiquitous Computing, (2007), pp. 19-37, vol. 4717,Springer Berlin Heidelberg.

Manne, Hannula et al., "Applicability of Triaxial Accelerometer for Energy Expenditure Calculation in Weight Lifting", Perspective Techologies and Methods in MEMS Design, MEMSTECH 2006, (May 2006), pp. 24-27, IEEE, Ukraine.

* cited by examiner

WEARABLE SENSOR SYSTEM WITH GESTURE RECOGNITION FOR MEASURING PHYSICAL PERFORMANCE

This application is based on Provisional Application 61/280,827, filed Nov. 9, 2009.

BACKGROUND OF THE INVENTION

1. Technical Field of the Invention

The invention relates to systems for quantifying physical performance, and the use of gesture recognition to control system operation.

2. Background of the Prior Art

Body-worn ("wearable") sensors are used by exercisers to measure physiological parameters such as heart rate and to infer caloric expenditure. Additionally, walkers, runners and cyclists use wearable sensors that measure physical performance parameters such as distance traveled and pace/movement speed. These devices improve motivation and provide valuable feedback for fitness program management. They are particularly popular for types of exercise that are mostly continuous in nature, in that the exercise sessions are typically uninterrupted until the session is completed. For example, a three mile run or a 10 mile bike ride.

By contrast, exercise routines designed to test and/or improve muscular strength and power are typically episodic or repetitive in nature; such routines are comprised of a number of distinct movements, "events" or "bouts" performed by the user. These movements, events or bouts of exercise are typically defined as sets and repetitions ("reps") to be performed. For example, the user may transition from one type of exercise, moving from a bench press to a squat, wherein a prescribed number of sets, repetitions and weight (load) for each exercise are performed. For the purposes of this application, the term "exercise set" shall mean one or more repetitions of a specific exercise that is performed continuously until completion. An "exercise set" has a distinct beginning and ending point. By way of example, the user may perform 10 repetitions of a bench press, which would comprise one "exercise set."

Strength and power training routines utilizing traditional training implements such as barbells, dumbbells, cables, kettle bells, medicine balls and similar have few practical means of objectively quantifying the user's physical performance, or providing real-time objective feedback beyond the user counting sets and reps performed for each type of exercise and then manually recording the weight (load) used for each exercise.

Biomechanics laboratories employ sophisticated and expensive instrumentation to measure such quantities as acceleration, velocity, power and mechanical work during weight lifting or similar training endeavors. However, this type of instrumentation requires laborious set-up procedures and post-processing for the data accumulated during testing or training.

Several studies have confirmed that accelerometers can be used to measure performance factors of interest to exercisers such as caloric expenditure, acceleration, velocity, force, mechanical work and similar. A research paper titled "Applicability of Triaxial Accelerometer for Energy Expenditure Calculation in Weight Lifting" concluded that a tri-axial accelerometer integrated into a wristwatch "seems to be applicable for energy expenditure estimation in weight lifting."

The study "Barbell Acceleration Analysis on Various Intensities of Weightlifting" noted that biomechanical characteristics of weightlifting techniques have been studied using accelerometers. Parameters measured included barbell trajectory, acceleration, and velocity as well as mechanical work and power output.

Several manufacturers of commercial/institutional grade strength training machines, often referred to as "selectorized" or "variable resistance" machines, incorporate means for quantifying the work performed by the user. However, such equipment is quite expensive, offers a limited variety of movement patterns and is typically only available at health clubs and rehabilitation facilities. And because such machines typically constrain or support the user during their use, some experts characterize this type of exercise as "less functional" and therefore less valuable for certain user groups than "free weights" and other "functional training" methodologies.

Several published U.S. patent applications teach sensor systems for quantifying the user's physical performance during strength and conditioning programs. One such prior art system that teaches the use of an accelerometer mounted in a glove worn by the user during training is U.S. 2008/0204225. The proposed device mounts two or more sensors on the user's body to assist in identifying the prescribed movement pattern from the resulting sensor signals. The invention teaches that the preferred location of the base station is near the user so the user can easily hit the "Start" and "Stop" buttons before and after each "exercise set" respectively.

The prior art system, U.S. 2008/0090703, teaches that the invention's sensor can be affixed to either a piece of equipment, for example, a weight stack of a selectorized strength machine or to a barbell, or alternatively can be worn on the user's body.

U.S. 2009/0069722 teaches a system where the sensing means, an accelerometer, can be attached to either the training implement to be lifted or it can be worn on the exerciser's waist belt. The user is instructed to press a key to initiate the system's calibration procedure in advance of starting the exercise.

Studies performed in a laboratory environment may rely on technicians and post-processing of the sensor signals to extract spurious signals from those produced by the intended movement. Spurious signals can be produced from such user activities as changing the load on the barbell, assuming a correct position for the next exercise or even brushing the hair from one's face or wiping sweat from one's brow.

The study "Tracking Free-Weight Exercises" (incorporated herein by reference) teaches methodologies for processing the signals generated from a 3-axial accelerator during weight training exercises. It also teaches the value of instituting a calibration procedure to improve recognition of sensor signals generated by user movement.

The prior art fails to teach a user-friendly and reliable means for the user to notify/signal the start and stop events of an "exercise set". The prior art teaches that the user must either interact with the "base station" located on the user's body (affixed to the upper arm or waist, for example), or the base station located somewhere in the exerciser's environment. It should be noted that providing notification of the start point of an exercise set is believed more important for reliable and accurate system operation than providing notification of the stop point of an exercise set. Foregoing notification of the stop event would not deviate from the teaching of the present invention.

Any movement by the user that generates sensor signals not directly attributable to the user's performance of an exercise set is defined by its nature as spurious. By way of example, the device instructs the user to perform a bench press with 150 pounds on the barbell. Accordingly, the user moves to the location of the bench press, adjusts the weight on the barbell to the desired amount, assumes the correct prone position on the bench, and finally grips the barbell with both hands in preparation to begin the exercise set. All of these preparatory movements by the user generate spurious signals that must be discriminated/identified by the device.

Accordingly, one method of minimizing or perhaps eliminating such spurious signals is to provide the user with the means of notifying the device of that moment in time and that position in space when the user is prepared to start the exercise set and when the user completes the exercise set. In this instance, "prepared to start" means the user has assumed a ready position with the user's hand or hands in position on the training device. The user "stops the exercise set" when the final repetition is completed, but the user's hand remains on the barbell. It should be noted that with certain training implements or training methodologies the ideal start and stop positions may be defined as the user's hand or hands being in close proximity rather than literally in contact with the training implement. Reliably determining the start and stop events is important for reliable and accurate data accumulating and processing.

When the base station is worn on the user's body, to provide notification (signal) of a start and stop point of an exercise set would necessitate that the user move one hand from the aforementioned start position and reach across the body to access the base station input means. This action creates spurious signals. Having the base station remote from the user's body merely compounds the spurious signals produced.

A user-friendly means for the user to input/signal/notify the start and stop points of an exercise set is important to creating a satisfying exercise experience. Reaching across one's body or especially moving to a remote base station at the start and stop points for each exercise set of a workout detracts from the experience.

The prior art teaches one means of addressing the aforementioned need for providing notification of stop and start for each exercise set to the device. Affixing the sensor to the training implement itself satisfies system notification, as only the actions of the user would cause the training implement to move. There are, however, a number of practical deficiencies associated with this approach.

First, it may be inconvenient for the user in a training environment wearing typical workout type clothing to transport a sensor and to frequently affix and remove the sensor from one training implement to another. Second, many training implements are coated with non-magnetic materials such as vinyl, plastic, rubber or non-magnetic metals, rendering magnetic mounting means impractical. Third, many exercise modalities involve the use of elastomeric cables, bands, medicine balls, shadow boxing, jump roping, heavy bags, Bodyblade® and similar that provide no suitable attachment point regardless of whether magnetic mounting or Velcro or similar attachment means are employed.

Fourth, several prior art devices teach affixing the sensor to the weight stack of a "selectorized" strength machine. However, for safety reasons, manufacturers of selectorized machines may cover the moveable weight stacks with shrouds that restrict user access to protect the user from injury to hand or fingers for product liability reasons. This may act to restrict access to the weight stack for such sensor mounting purposes.

Fifth, selectorized strength machines are designed to increase or decrease the resistance provided to the user to match the changes in the user's joint leverage during an exercise. The performance specs of cams used to control the weight stack are believed to vary between machines and manufacturers. A cam is defined as: "A cam is an ellipse connected to the movement arm of the machine on the belt or cable on which it travels. The purpose of the cam is to provide variable resistance, which changes how the load feels (but the actual weight never changes) as the lifter moves through the range of motion of the exercise. The reason the perception of the weight needs to change is that each joint movement has an associated strength curve". It is believed that the distance traveled by the weight stack for a given load/weight and exercise pattern is not uniform among commercially available machines. Consequently, the amount of travel/movement of the weight stack for a given load/weight may not correlate accurately with actual work performed.

BRIEF SUMMARY OF THE INVENTION

An object of the present invention is to overcome deficiencies of prior art user wearable sensor systems for measuring physical performance. Another object of the present invention is the use of gestures by the user of the wearable sensor system to start and stop the processing of information provided by the wearable sensor system.

A principal object of the present invention is to employ motion sensing means that provides three axes of linear motion measurement. A feature of the user wearable sensor system is an annulus or sensor ring disposed about a user's finger, preferably the index finger. Another feature of the user wearable sensor system is an accelerometer disposed within the sensor ring. An advantage of the user wearable sensor system is that measured finger motions, that include but are not limited to speed, vector of movement, and travel distance, provide more distinctive and repeatable body motions of the user for starting and stopping the processing of user exercising information. Another advantage of the user wearable sensor system is that the same sensor ring is capable of providing user exercise information based upon finger motions with typically lower speeds and greater distance traveled during the user's exercise program.

Another object of the present invention is to employ an information processor or "base station" to calculate and display predetermined exercise parameters that inform the user of the level of exercise he or she has or is attaining. A feature of the user wearable sensor system is a transceiver disposed within the sensor ring. An advantage of the user wearable sensor system is that sensor ring is capable of remotely transmitting (without wires) exercise information to the information processor. Another advantage of the system is that the information processor is capable of receiving the transmitted information or signals, and processing information such that the user is provided "feedback" as to his or her level of physical performance. Still another advantage of the system is that the information processor or base station may be secured to the user's arm or elsewhere on the user's body or may detached from the user and remotely positioned to receive signals form the sensor ring's transceiver.

The sensor ring synergistically serves two distinct and essential purposes for operation of the present invention. One purpose is to measure accelerations resulting from movement of the user's hand during physical activities. For this purpose, the ring sensor may result in a more stable affixing to the user's body than mounting a sensor on a belt, glove or arm band as taught in the prior art. Stable mounting of the sensor minimizes spurious signals created by unwanted sensor movement not directly attributable to the intended movement to be measured. The sensor ring also represents a more sanitary mounting means than belts, gloves, straps and similar materials that may readily absorb body perspiration.

The second purpose of the sensor ring is gesture recognition means for inputting position and time sensitive information to the base station. For the contemplated "kinetic" applications for which the device will measure, it is advantageous for the user to have the ability to input certain key information regardless of the position of the user's hand(s) in physical space. Specifically, the device's novel gesture recognition capability allows the user to input information to the base station when the user's hand(s) are not in contact with, or in close proximity to the base station, which is a frequent occurrence during an exercise program. The user's ability to input information when the user's hand(s) are in contract with, or in close proximity to, the exercise implement is desirable.

The mounting point of the sensor ring enables the invention's gesture recognition capabilities. The finger is uniquely capable of producing high-frequency, low amplitude movements that are very distinctive; for example, two repetitions of rapid finger extension and flexion (about 90 degrees of finger movement) by the user are clearly distinguishable from the typically lower frequency, larger amplitude limb or core movement associated with exercise. The result is that gesture commands that are readily distinguishable from typical exercise patterns can be readily developed.

An exemplary embodiment incorporates sensor means for also measuring orientations associated with the movement of the sensor ring. Accordingly, the number and types of gestures recognized by the device could possibly be expanded. For example, the additional capability to measure orientation could possibly more reliably detect circular motions of the sensor ring. The circular motion scribed by the sensor ring could be clockwise or counter clockwise.

With the preferred embodiment the sensor ring is comprised of an accelerometer preferably with three axis of measurement. This configuration would reduce the cost of manufacturing and perhaps the size of the sensor ring as compared with the addition of the sensor means to measure orientations. There are a number of sensor configurations that could be employed that would not deviate from the novelty and functionality of the present invention. For example, the affixing of the sensor in proximity of the finger, such as the hand or wrist area.

To accomplish the foregoing and related ends, the invention comprises the features hereinafter fully described. The following description and the annexed drawings set forth in detail certain illustrative embodiments of the invention. These embodiments are indicative, however, of but a few of the various ways in which the principles of the invention may be employed. Other objectives, advantages and novel features of the invention will become apparent from the following detailed description of the invention when considered in conjunction with the drawings.

DETAILED DESCRIPTION OF THE INVENTION

A wearable sensor system 98 with gesture recognition for measuring physical performance includes a wearable sensor 100 attached in the proximity of the user's fingers can provide novel and valuable information relating to the user's performance during strength and conditioning training exercise programs. This movement information generated by the sensor is the basis for quantification and real-time and/or post-exercise session user feedback for management of fitness, performance and rehabilitation programs. This same sensor system provides two distinct and valuable functions; the measurement of user performance and as a gesture recognition means for inputting instructions when the user's hand(s) are not in contact with, or in close proximity to, the base station to enhance the user-experience and improve accuracy and reliability.

Figure 1A:
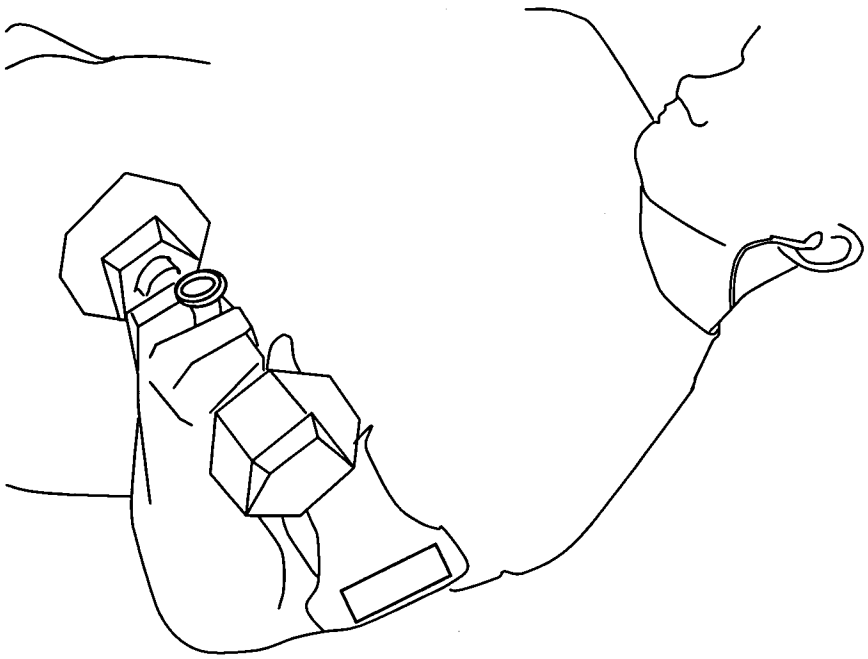
FIG. 1A illustrates the user performing an exercise set with a dumbbell with the sensor ring on his left hand and a base station strapped to his left upper arm in accordance with the present invention.
Figure 1B:
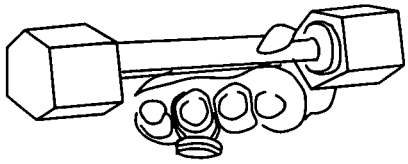
FIG. 1B illustrates the user notifying the device that the exercise set is starting or just completed via movement of the sensor ring in accordance with the present invention.

Referring now to the drawings, the invention operates in "real time" and includes a wearable sensor that is a finger ring 100 or annulus (the "sensor ring") worn by the user. In the preferred embodiment the sensor ring 100 is an accelerometer 106 capable of providing three axes of linear motion measurement. The sensor ring 100 is coupled to a transmitter or transceiver 108 and battery (not depicted), described in more detail below. FIG. 1A illustrates a user wearing the sensing ring 100 and the base station (information processor) 101 and an ear bud 103 to receive aural feedback. FIG. 1B depicts the user's finger wearing the sensor ring 100 in an extensive (extended) position as part of a gesture to provide notification to the device.

The invention further includes a body-worn base-station 101 that communicates with the sensor ring 100. If the base-station 101 does not have built-in capabilities for communicating with the sensor ring 100, the base-station 101 may be expanded with a receiver or transceiver device to enable it to communicate with the device. The base-station may also have display, sound, and/or internet capabilities to facilitate real-time feedback and uploading/downloading of data to the internet. The Apple iPod or iPhone or similar device is representative of one embodiment of the body-worn base station. An alternative to the body worn base station is a base station located remote from the user's body. A PC with receiver or transceiver means would be suitable. The base station custom software programs ultimately extract the desired information generated from the sensor 100, calculate data related to the user's performance, store pre-program workout routines, direct the user during a routine, record the user's performance, and provide real-time and/or post-exercise feedback.

Figure 2:
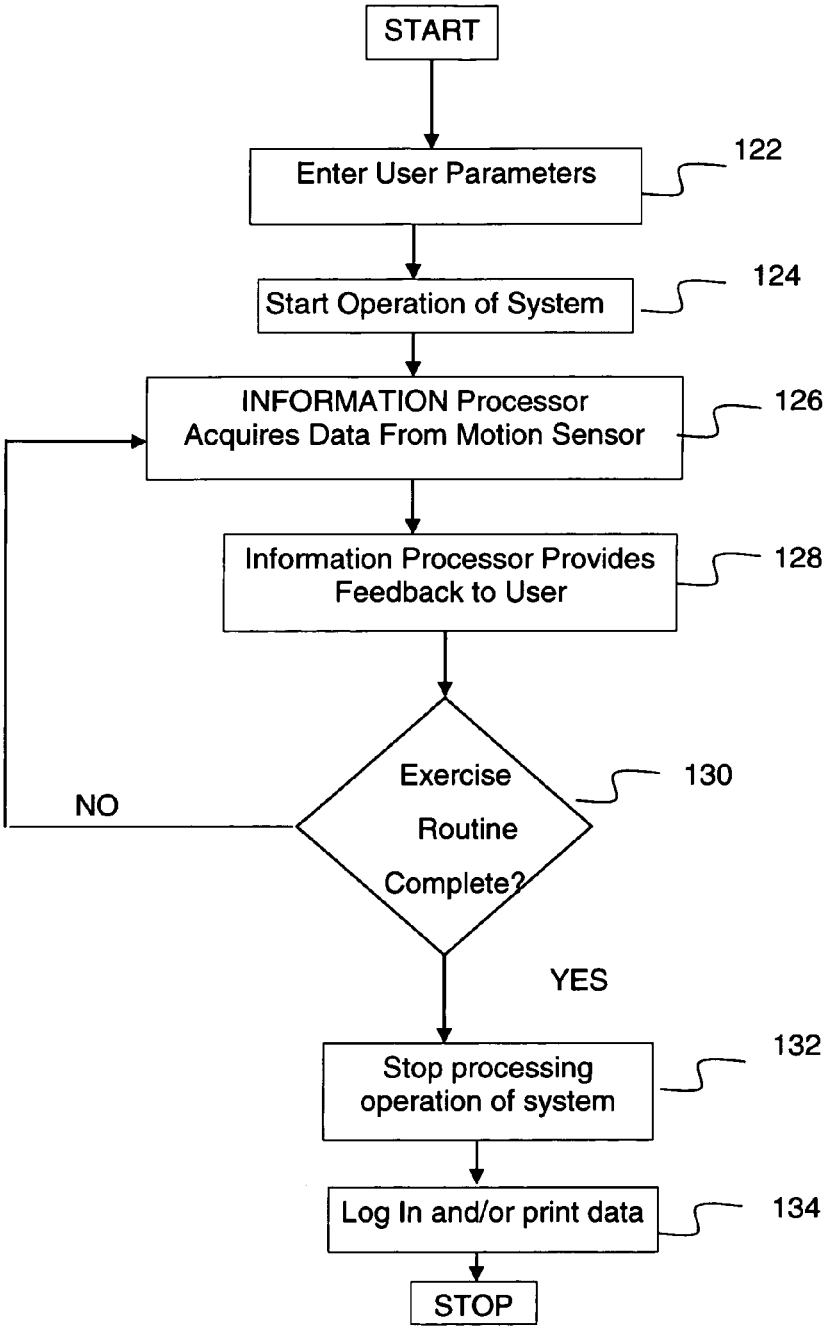
FIG. 2 illustrates a flow chart of a wearable sensor system with gesture recognition for measuring physical performance in accordance with the present invention.

The invention has several operational modes. Two operational mode examples are: 1) a Device-Directed Mode where the device delivers pre-established training protocols to which the user follows and receives aural, visual or tactile feedback, and 2) a User-Directed Mode where the user proceeds with a workout without direction from the invention with the exception of feedback if so elected by the user. Although the invention may include the user selecting an operating mode, an alternative embodiment of the present invention includes a wearable sensor system 98 that is pre-programmed such that the operational mode is preset and not user selectable. FIG. 2 depicts a flow chart of the device's operation sequence without an operational mode selection block, thereby promoting a preset operational mode for the wearable sensor system 98.

In the event that the invention does not operate in a real time mode, the sensor ring 100 will include memory that stores the user's exercise session that can later be downloaded to a base station.

To perform as intended the device should offer a user-experience that is intuitive and provides readily assimilated and relevant information. An example of a satisfying user-experience for a wearable sensor system is the Nike+ iPod. A system that requires the affixing of multiple sensors to the user's body may increase cost and complexity. Cumbersome means for the user to provide notification of the start and stop points for each exercise set may also dampen the user-experience. The quality of the user-experience is believed to be dependent upon a user's acceptance of a wearable/body-worn fitness product.

Reliable and accurate measurement of user performance for exercise routines that may be comprised of a series of episodic or repetitive events depends on the system's effectiveness in discriminating spurious movement artifact from movement produced by the actual exercise intended to be measured. The preferred method of minimizing or perhaps eliminating such spurious signals is to provide the user with the means of notifying the device of that moment in time and that position in space when the user is prepared to start the exercise set and when the user stops the exercise set respectively.

In this instance, "prepared to start" means the user has assumed a ready position with the user's hand or hands in position to begin the exercise set. The user "stops the exercise set" when the final repetition is completed, but the user's hand remains on or near the training implement. It should be noted that with certain training implements or training methodologies the ideal start and stop positions may be defined as the user's hand or hands being in close proximity to each other rather than literally in contact with exercise equipment. Reliably determining the Start and Stop moment-in-time and proximity for exercise sets is important for reliable and accurate data accumulating and processing.

It should be recognized that the proper notification of each start and stop event is advantageous, but the present invention will also employ well-known software algorithms for the purpose of extracting spurious signals generated by unanticipated finger movements.

Providing a user-friendly means for the user to notify the system as described above is a desired feature. It is also desirable that such input means not increase manufacturing costs or complexity by requiring additional hardware components. The sensor ring is designed to synergistically serve both functions of tracking and notification.

User notification of key events associated with an exercise set start is especially beneficial for exercise programs not directed by the present invention. In "device-directed" operating mode, the user selects a pre-planned exercise routine and the device delivers to the user pre-established training protocols to which the user responds and receives selected feedback. With this operating mode, the type of exercise and the load/weight employed by the user is known to the device. This knowledge facilitates the system's sensor signal recognition and processing duties. It must be noted that this knowledge facilitates, but does not uniformly address the effects of spurious signals.

With the user-directed operating mode, the user undertakes an exercise session that is not directed by the device, but is rather determined by the user. Since the device has no advance knowledge of the exercise to be performed or the amount of any weight/load to be used, it is especially desirable for the user to have a user-friendly means of notifying the system that an exercise set is to begin and when said exercise set is completed. This notification process essentially allows the user to "tag" or "mark" a particular exercise set and subsequently enter pertinent information such as the weight/load employed and the type of exercise pattern so that device can calculate desired performance factors and for archival purposes. For example, the user may wish to engage in a test of strength with another user of the device. Each user can elect to store (archive) a particular exercise set for immediate or future review. The user can elect to revisit this personalized portion of his or her workout, and enter the type of exercise and load/weight employed for memorializing the results of user-directed activities.

Affixing of a motion-detecting sensor in a manner that minimizes unwanted spurious signals caused by movement of the sensor not representative of the user movement to be measured is important. Mounting the sensing system in a properly fitted finger ring is the preferred means rather than encapsulating the sensor in a glove or belt or similar wearing attire.

The sensor ring's gesture recognition capability facilitates inputting of data to the base station by the user. The finger is uniquely capable of producing high-frequency, low amplitude movements that are very distinctive from typical exercise patterns intended to be measured by the device. Various gestures recognizable by the device can be enabled to facilitate user input of information. For example, the finger can be made to rapidly extend ("extension") and flex ("flexion") for one of more repetitions (about 90 degrees range of motion) for a recognizable gesture readily distinguishable from lower frequency, large amplitude limb movement produced from the user performing a bench press, press or similar exercise movement.

In the preferred embodiment, the user executes an easily performed "gesture" by causing the finger wearing the sensor ring to move in a manner consistent with an established gesture recognition pattern in order to provide notification, control the operation of the system or input certain information. Gestures were designed to be executable from many different body positions and postures. This is especially valuable when the hand wearing the device's ring is in close proximity to the training implement, or in some instances, the ring 100 is in contact with the training device. This proximity acts to minimize the time period and physical distance between system notifications in which spurious signals could occur. This capability is especially valuable when the user's hand(s) are not in close proximity to the base station. Recognizable gesture movements can range from approximately one-half inch to four or more inches for finger movement distance with approximately one inch being a preferred range of movement distance. Preferably the gesture movement is of a sufficiently large magnitude to distinguish it from spurious movements of the finger while still allowing persons with smaller fingers to successfully perform the gesture. A gesture calibration procedure could be performed to ensure the device recognizes each individual's gestures. For certain gestures, the time to complete a recognized gesture may be approximately 50 milliseconds to 500 milliseconds.

Figure 4:
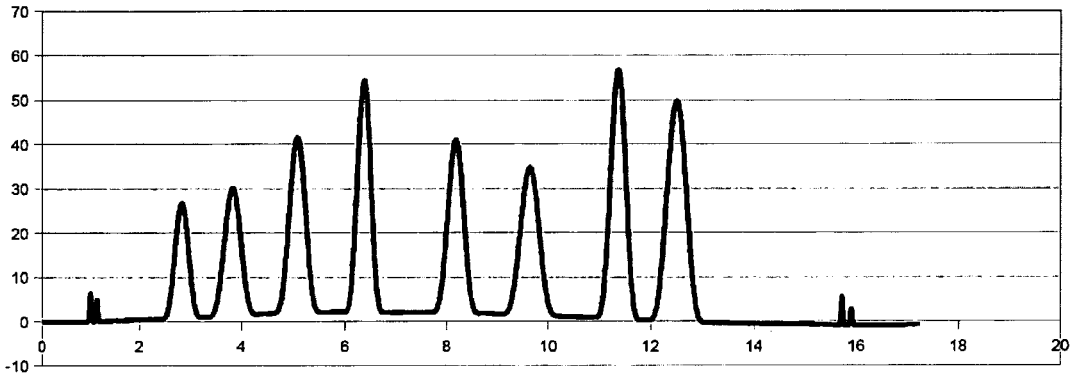
FIG. 4 depicts the measured accelerations from a tri-axis accelerometer attached to the index finger of the user during a set of a particular fitness workout in accordance with the present invention.

FIG. 4 depicts the measured accelerations from a tri-axis accelerometer attached to the index finger during a set of a particular fitness workout. The user is holding a four pound weight in the hand with the sensor attached. The user starts the system 98 operation at the beginning of the exercise set by rapidly extending, tapping (one or more times) or otherwise moving his or her finger wearing the sensor ring against the grip portion of the weight the user is holding. This is easily seen in the waveform plot at the beginning of the chart as two distinct changes (taps) in the acceleration in the z-axis. Two seconds later, the user begins their workout set and proceeds to move the weights in four successive reps. Two seconds after that, the user rapidly double taps their finger again, which is seen at the end of the waveform in the second box. The low amplitude, short period double taps can easily be identified at the beginning and end of the waveform and the software is able to segment them out from the sensor data during and after the workout. This is illustrative of how gesture recognition provides an easy and reliable method for signaling the start and end of a workout.

The sensor ring in an exemplary embodiment is capable of measuring orientations as well as accelerations by use of a tri-axis inclinometer or similar sensor well known to those of ordinary skill in the art. Accordingly the number and types of gestures recognized by the device may be expandable. A six axis sensing capability would enable a more sophisticated and greater variety of gestures that are easily performed by the user and recognizable by the device. For example, the user may now be able to use the tilt (relative to the palm of his or her hand) of their finger to communicate a particular signal to the device. Tilting the finger in the upward direction would mean the weight is being increased, while tilting the finger downward may mean the user is decreasing the weight of the workout. Along with expanding the gesture library, having six axis of measurement would allow the device to distinguish workout types more easily. For example, it may allow the device to determine how the hand was being held to determine if the user was performing a prone bench press or an inclined bench press.

Though a finger ring is the preferred embodiment because of the uniquely distinguishable finger movement, mounting the sensor system on the back of the user's hand or wrist area, for example, can serve as an alternative location to enable the gesture recognition capabilities of the present invention.

In the preferred embodiment, the base station is worn/carried on the user's body. By way of example, the base station could be an Apple iPod Touch or iPhone. Alternatively, the base station can be of a dedicated design specifically for use with the present invention. The portability of the base station is an important factor for many intended applications, as the user will be performing vigorous exercises while having the option of receiving aural, visual or tactile biofeedback from the base station.

The preferred embodiment of the present invention measures the accelerations of the sensor during movement. To calculate certain key performance parameters such as force, power and mechanical work, the amount of weight/load to be lifted during the exercise must be known to the device or base-station. Such information may be entered to the device with specific gestures to signal the amount of weight and/or exercise being performed, or it may be entered into the base station via its input capabilities. The present invention can also measure the time intervals between exercise sets and/or repetitions and sets performed, as well as total exercise time.

The base station may also upload or receive user data and information to a personal computer (via hard wire, bluetooth or wifi), and/or to a remote system preferably via a network connection, such as over the internet, which may be maintained and operated by the user or by a third party.

This approach may allow for more convenient storage, maintenance, retrieval, and further processing of the collected exercise-related data as compared to limiting the user interface, data processing, and/or computational capabilities of the overall system to operations performed through the base station.

In addition to storing historical data and information, this approach enables downloading of data and information from one or more remote systems to the user, such as a PC or other devices and/or to the portable device. This downloaded data and information may include: pre-programmed workouts or other content including coaching and/or motivational content; comparative data; coaching, safety and the like.

The remote system may be accessed by multiple users (e.g., over a network, such as the internet), and such systems may provide a wide variety of data and information to users. This invention further may allow users to compare their workout routines, data, and/or performance level to other information, such as: their own stored workouts; stored workouts of other users of a remote system; similar workouts of well known athletes and the like.

Because at least some portions of systems and methods according to examples of this invention may receive data from multiple users, users can compete against one another and/or otherwise compare their performance even when the users are not physically located in the same area and/or are not competing at the same time.

The invention has expansive testing and training functionality beyond the physical performance, fitness and rehabilitation settings, which includes but is not limited to serving as an evaluation and/or training tool for conventional physical tasks in settings such as the home or in an industrial setting.

Data from the invention can be transferred to a processing system and/or a feedback device (audio, visual, etc.) to enable data input, storage, analysis, and/or feedback to a suitable body-worn or remotely located electronic device. The user may receive real-time feedback in the form of coaching tips—typically via voice guidance. Feedback may be audible, tactile and/or visual, or by other suitable means. Feedback (messages) can be provided continuously.

One exemplary embodiment enables the user to download results to devices that include but are not limited to, one or more personal computers (PC), personal digital assistants (PDA) and/or mobile phones, for personal display of a data "dashboard." A training history can be archived on the user's device or at a remote location for activity sharing, where a website enables the user to post activities to share with friends and other users.

Visual feedback could be delivered by the base station display, heads-up displays (glasses) or display devices positioned within sight of the user, such as monitors, projection systems and similar devices. Feedback may also be supplied by the device itself if enabled with suitable display/signaling capabilities such as a light which may illuminate or flash, or a small embedded display.

The interaction of the user with the device may be characterized as follows. The user selects either a device-directed or user-directed training mode of operation. In either case the weight and/or type of training implement to be used has previously been programmed into the device or can be programmed into the device by the user. The user proceeds to the training implement and assumes the proper position to begin. The user notifies the device, by way of example, by executing two rapid flexion/extension movements of the finger wearing the sensor ring. The device may then signal to the user, if the user so selects this optional capability, that she may begin the exercise set. Feedback can be delivered to the user in essentially real-time if the user so selects. Other gestures recognizable to the device could also be employed.

The user then executes the exercise set. Upon completion, the user notifies the device that the exercise set has been completed, again by way of example, by executing two rapid flexion/extension movements of the finger wearing the sensor ring. The device then calculates the selected performance parameters, or may simply store the raw sensor data for further processing in the device itself or for transmission to the base-station.

The data acquired by the sensor ring, being the raw sensor data or processed data, is transmitted to the base station. Many options exist for low powered transmission means of such data, but the preferred embodiment uses a RF (radio frequency) signal to communicate with the base-station. The base-station can then further process the raw or already processed data to generate real-time feedback for the user, or provide end-of-workout reports showing the performance parameters selected. The base-station may then communicate with a centralized data storage center via the internet to send or compare the user's performance data with other users.

The portability of the base-station is an important factor, as the user will be performing vigorous exercise while receiving biofeedback. The base-station runs the requisite algorithms for error recognition and similar activities and provides feedback in response to established parameters. The visual feedback could be delivered by the display of the base-station, and the audio feedback can be provided with built in speakers or earphones as illustrated in 103 of FIG. 1A.

For each repetition of an exercise set, the present invention measures the accelerations imparted on the device and the time taken to complete the repetition. With knowledge of the weight (mass) used, the device can calculate power (energy expended over time), strength/power (ability to produce force), work (force times distance) and total calories expended (proportional to total mechanical work). And it also counts repetitions and sets. The methods employed to calculate these parameters are well-known and are taught in the prior-art.

The ring or annulus 100 further includes a CC430 MCU (303) processor 109 for conditioning accelerometer 106 signals for transmission via the transceiver 108. An alternative MCU or processor may be substituted with sufficient capabilities. The CC430 has a built in wireless transceiver, but a separate transceiver or transmitter may also be used. A 3-axis accelerometer from VTI part number CMA3000 or equivalent can be used. If using the CC430 a USB-based CC1111 wireless transceiver can connect to a PC or similar information processor 101 to allow the information processor to function as a base station and communicate with the annulus 100. If the transmitter/transceiver in the annulus is not the CC430, a compatible receiver or transceiver can be used to communicate with between the annulus 100 and base-station 101. The processor 109, accelerometer 106, and transceiver 108 are installed in the annulus 100 via means well known to those of ordinary skill in the art.

The software is written for monitoring the tri-axis movement of the accelerometer 106 for the start/stop gesture. The software also processes the incoming acceleration data and saves any relevant processed data, or raw data to the annulus. Once the stop gesture has been completed the annulus 100 can be programmed to send data remotely to the PC (base station 101) via the wireless transceiver 108 for processing the data. Software can then be developed for the base-station 101, which receives the incoming data from the annulus 100 for display or uploading the data to the internet for sharing with other users.

If more memory is desired for storing workout data, or a different transmission protocol is warranted, the developer can opt to assemble their own device by using suitable components. A sample device only needs to contain a means for processing the data such as a CPU or MCU, a transmitter/transceiver, and power source. The base-station can be constructed using a compatible receiver/transceiver and input connection to a PC.

Figure 3:
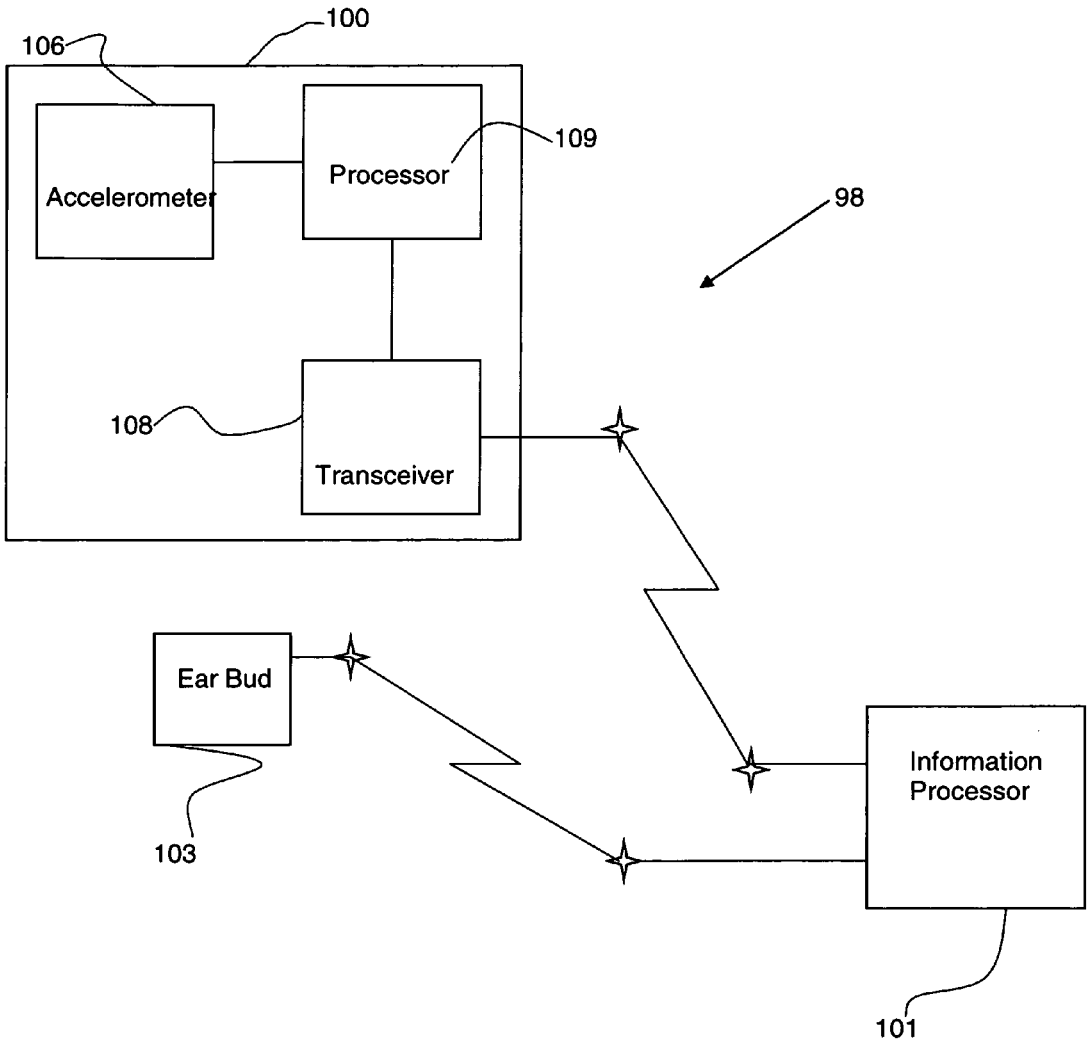
FIG. 3 depicts a block diagram of the wearable sensor system with gesture recognition for measuring physical performance in accordance with the present invention.

Referring to block 120 in FIG. 3, the user starts the system for quantifying physical performance and for using gesture recognition to control the system operation 98 by entering his or her physical parameters (height, weight, age, sex, etc.) and the type of exercise (weight lifting, running, jumping, etc.)—block 122. The user then starts system operation (block 124) by moving the finger that the ring sensor 100 is disposed upon a predetermined distance in a predetermined time period. Upon starting system operation, the information processor 101 then acquires data from the motion sensor 100 (block 126). The data is processed by the information processor 101 then "fed back" to the user via a display to allow the user to evaluate his or her performance of the selected exercise routine (block 128). The information processor 101 will continue acquiring data and feeding back information to the user until the user completes the exercise routine 130, whereupon, the user stops system operations by moving his or her finger with the sensor ring 100 thereupon, a predetermined distance in a predetermined time period (block 132). The system then logs in and/or prints out data accumulated during the exercise routing (block 134). The system then stops operating until re-started by the user.

The invention claimed is:

1. A system for quantifying physical performance and for using gesture recognition to control system operation comprising:

means for measuring three axes of linear motion, said measuring means being secured to a user's finger;

means for inputting said measured three axes of linear motion into processing means;

means for starting said measuring of said three axes of linear motion via hand positioning and/or hand movement;

means for minimizing spurious measurements of said three axes of linear motion;

means for providing an acceleration magnitude corresponding to said measured three axes of linear motion;

means for stopping said measuring of said three axes of linear motion via hand positioning and/or hand movement; and means for calculating and indicating predetermined parameters of physical exercise, whereby said measuring means provide parameters pertaining to acceleration magnitude and high-frequency, low amplitude finger movements and/or gestures, said acceleration magnitude and said finger movements providing continuous information from a finger start gesture to a finger stop gesture to said processing means for quantifying and displaying physical performance data for a time period determined by said finger start gesture and said finger stop gesture.

2. The system of claim 1 wherein said measuring means includes an accelerometer encased in an annulus disposed about the user's finger.

3. The system of claim 2 wherein said inputting means includes a transmitter encased in an annulus disposed about the user's finger.

4. The system of claim 3 wherein said inputting means includes a base-station having receiving, computer, display and download capabilities.

5. The system of claim 4 wherein said base-station is secured to the user.

6. The system of claim 4 wherein said base-station is distally disposed relative to the user.

7. The device of claim 4 wherein said starting means includes a predetermined high frequency, low amplitude movement of the user's finger with the annulus thereupon, said finger movement being recognized by said base-station via signals generated by said accelerometer that correspond to said finger movement.

8. The device of claim 4 wherein said stopping means includes a predetermined high frequency, low amplitude movement of the user's finger with the annulus thereupon, said finger movement being recognized by said base-station via signals generated by said accelerometer that correspond to said finger movement.

9. The system of claim 1, further comprising means for selecting an operating mode of the system.

10. The system of claim 9 wherein said means for selecting an operating mode includes means for initializing an exercise routine.

11. The system of claim 9 wherein said means for selecting an operating mode includes means for selecting between 1) a device-directed operating mode that allows said system to deliver pre-established training protocols that the user ultimately follows; and 2) a user-directed mode that allows the user to control his or her training program without any input from said system.

12. The device of claim 1 wherein said means for minimizing spurious measurements includes means for notifying said processing means of the time and position in space of the user's finger that corresponds to beginning an exercise set; and means for notifying said processing means of the time and position in space of the user's finger that corresponds to finishing the exercise set.

13. The device of claim 1 wherein said means for calculating and indicating predetermined parameters of physical performance includes power, strength, work, total calories expended, visual feedback, audio feedback, set quantification, rep quantification and/or tactile feedback.

14. A physical exercise method, said method comprising:

mounting a sensor on a hand, a wrist, or a finger of a user, wherein the sensor includes an accelerometer;

communicating movement of the sensor, detected by the accelerometer, to an information processor;

after the mounting the sensor, recognizing at least one start gesture that involves movement of the accelerometer, communicated to the information processor; and after the recognizing the at least one start gesture, tracking movement of the sensor while the user performs physical exercise with exercise equipment, and calculating motion parameters of the physical exercise from tracked movement of the sensor.

15. The method of claim 14, wherein the mounting includes mounting the sensor on the finger of the user; and wherein the recognizing the at least one start gesture includes recognizing a movement of the finger.

16. The method of claim 15, wherein the recognizing the movement of the finger includes recognizing a tapping or an extending of the finger.

17. The method of claim 15, wherein the recognizing the movement of the finger includes recognizing movement of the finger while the finger is in contact with the exercise equipment.

18. The method of claim 15, wherein the sensor is a finger ring; and wherein the mounting the sensor includes putting the finger ring on the finger.

19. The method of claim 14, wherein the communicating includes wirelessly communicating the movement to a base station, using a transmitter or transceiver of the sensor.

20. The method of claim 14, further comprising, after the recognizing the at least one start gesture, recognizing at least one stop gesture that involves movement of the sensor, and stopping the calculating the motion parameters after the recognizing the at least one stop gesture.

21. The method of claim 14, wherein the exercise equipment includes a free weight; and wherein the calculating includes counting one or more of repetitions and/or sets involved in moving the free weight.

22. The method of claim 14, wherein the calculating includes calculating one or more of power, strength/power, work, and/or total calories expended.

23. A device for providing exercise information to a user while the user is exercising comprisinq:

an accelerometer disposed about a user's finger for measuring motion of the user's finger;

an information processor that receives information from said accelerometer via a wireless system, said information processor being programmed to calculate motion parameters via said received information;

means for starting and stopping the calculation of said motion parameters by said information processor; and means for indicating predetermined quantities of physical performance of the user to the user while the user is exercising, whereby the user is capable of providing exercise motion information to the information processor and to start and stop the operation of the information processor via an accelerator disposed about one finger;

wherein said means for indicating predetermined quantities of physical performance includes means for reading acceleration magnitude and finger movement information by said information processor, for quantifying and displaying physical performance data for a time period determined by at least one finger start gesture and at least one finger stop gesture.

24. The device of claim 23 wherein said at least one finger start gesture and said at least one finger stop gesture include high-frequency, low amplitude finger movements and/or gestures; and wherein said means for starting and stopping includes means for recognition of said at least one finger start gesture and said at least one finger stop gesture.

25. The device of claim 24 wherein said at least one start gesture includes substantially about a one inch movement of an end portion of the finger that said accelerometer is disposed upon, said one inch movement occurring in substantially about a 100 millisecond time period; and wherein said means for recognition of said at least one finger start gesture and said at least one finger stop gesture includes means for recognition of said movement of said end portion.

26. The device of claim 25 wherein said at least one stop gesture includes substantially about a one inch movement of said end portion of the finger that said accelerometer is disposed upon, said one inch movement occurring in substantially about a 100 millisecond time period; and wherein said means for recognition of said at least one finger start gesture and said at least one finger stop gesture includes means for recognition of said at least one stop gesture that includes said movement of said end portion.

* * * * *